US007748222B2

(12) United States Patent
Bernier et al.

(10) Patent No.: US 7,748,222 B2
(45) Date of Patent: Jul. 6, 2010

(54) PERFORMANCE OF A COMBUSTION CHAMBER BY MULTIPLE WALL PERFORATIONS

(75) Inventors: Daniel Francis Paul Bernier, Massy (FR); Jean-Michel Jacques Campion, Moisenay (FR); Stéphane Henri Guy Touchaud, Vincennes (FR)

(73) Assignee: SNECMA, Paris (FR)

( * ) Notice: Subject to any disclaimer, the term of this patent is extended or adjusted under 35 U.S.C. 154(b) by 824 days.

(21) Appl. No.: 11/544,554

(22) Filed: Oct. 10, 2006

(65) Prior Publication Data

US 2007/0084219 A1 Apr. 19, 2007

(30) Foreign Application Priority Data

Oct. 18, 2005 (FR) ..... 05 10584

(51) Int. Cl.
*F02C 1/00* (2006.01)
*F02G 3/00* (2006.01)

(52) U.S. Cl. ..... 60/754; 60/752

(58) Field of Classification Search ..... 60/752–760, 60/804

See application file for complete search history.

(56) References Cited

U.S. PATENT DOCUMENTS 3,572,031 A * 3/1971 Szetela ..... 60/757
3,990,837 A * 11/1976 Snell ..... 60/752
4,180,972 A * 1/1980 Herman et al. ..... 60/800
4,244,178 A * 1/1981 Herman et al. ..... 60/754
4,269,032 A * 5/1981 Meginnis et al. ..... 60/754
4,296,606 A * 10/1981 Reider ..... 60/754
4,302,940 A * 12/1981 Meginnis ..... 60/754
5,241,827 A * 9/1993 Lampes ..... 60/754
5,261,223 A 11/1993 Foltz
5,775,108 A 7/1998 Ansart et al.
6,145,319 A 11/2000 Burns et al.
6,408,629 B1 * 6/2002 Harris et al. ..... 60/804
6,427,446 B1 * 8/2002 Kraft et al. ..... 60/737

(Continued)

FOREIGN PATENT DOCUMENTS

EP 0 943 868 A2 9/1999

(Continued)

OTHER PUBLICATIONS

U.S. Appl. No. 12/256,026, filed Oct. 22, 2008, Campion, et al.

*Primary Examiner*—William H Rodríguez
(74) *Attorney, Agent, or Firm*—Oblon, Spivak, McClelland, Maier & Neustadt, L.L.P.

(57) ABSTRACT

An annular wall for the combustion chamber of a turbomachine has a cold side and a hot side, said wall being provided with a plurality of primary holes and a plurality of dilution holes distributed in circumferential rows, together with a plurality of cooling orifices that are distributed in a plurality of circumferential rows that are spaced apart axially from one another, the number of cooling orifices being identical in each row thereof, and the wall further including bores disposed immediately downstream from the primary holes and from the dilution holes and distributed in circumferential rows, the bores in any one row presenting a substantially identical diameter, being spaced apart at a pitch that is constant, and presenting intrinsic characteristics that are different from the intrinsic characteristics of the cooling orifices of the adjacent rows.

9 Claims, 2 Drawing Sheets

U.S. PATENT DOCUMENTS

| | | | | |
|---|---|---|---|---|
| 6,434,821 | B1 * | 8/2002 | Nelson et al. | 29/888.01 |
| 6,474,070 | B1 * | 11/2002 | Danis et al. | 60/739 |
| 6,513,331 | B1 * | 2/2003 | Brown et al. | 60/754 |
| 6,620,457 | B2 * | 9/2003 | Farmer et al. | 427/235 |
| 6,655,149 | B2 * | 12/2003 | Farmer et al. | 60/754 |
| 7,093,439 | B2 * | 8/2006 | Pacheco-Tougas et al. | 60/752 |
| 7,216,485 | B2 * | 5/2007 | Caldwell et al. | 60/772 |
| 2008/0010992 | A1 * | 1/2008 | Patterson et al. | 60/772 |

FOREIGN PATENT DOCUMENTS

| | | |
|---|---|---|
| EP | 1 001 222 A2 | 5/2000 |
| FR | 1 493 144 | 8/1967 |

* cited by examiner

FIG.2
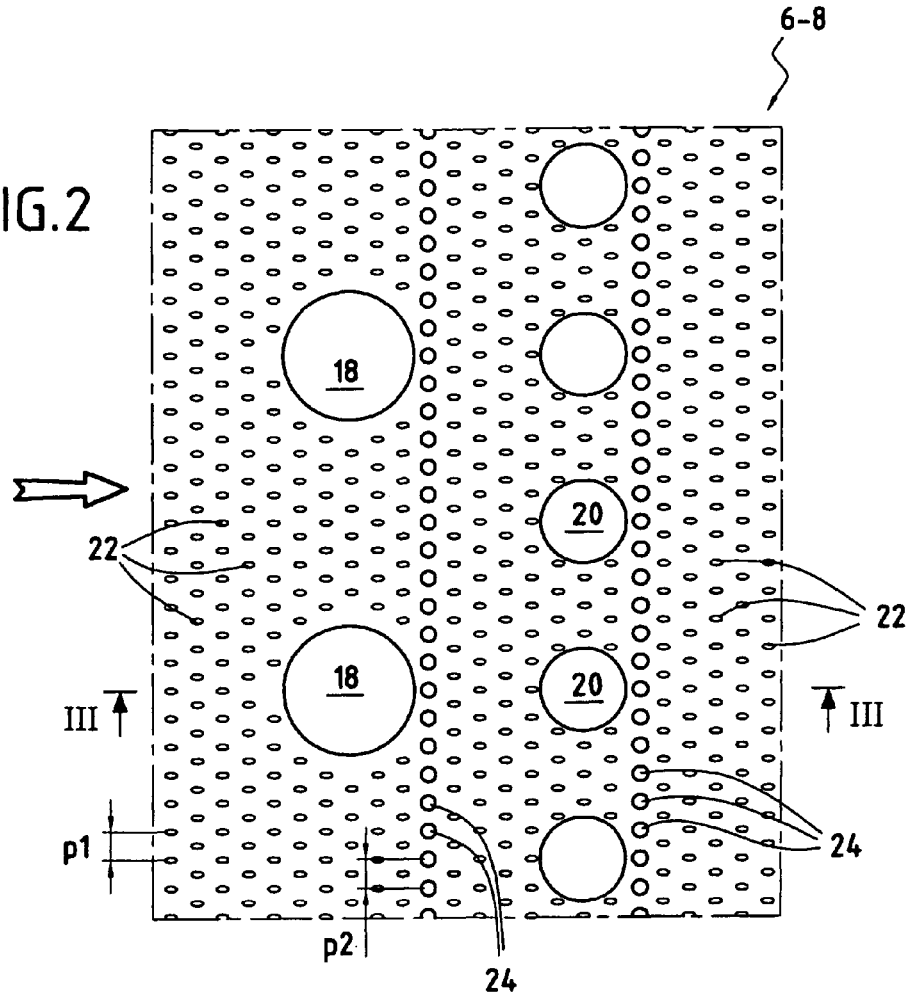
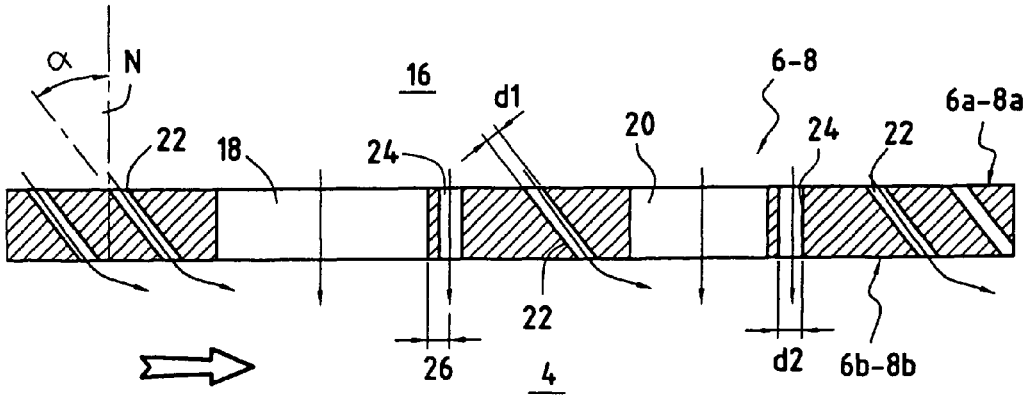
FIG.3

PERFORMANCE OF A COMBUSTION CHAMBER BY MULTIPLE WALL PERFORATIONS

The present invention relates to the general field of combustion chambers for turbomachines. It relates more particularly to an annular wall for a combustion chamber cooled by a "multiple perforation" technique.

BACKGROUND OF THE INVENTION

Typically, an annular combustion chamber for a turbomachine is formed by an inner annular wall and an outer annular wall that are interconnected at an upstream end by a transverse wall forming a chamber end wall.

The inner and outer walls are each provided with a plurality of holes and various orifices allowing the air flowing around the combustion chamber to penetrate into it.

Thus, so-called "primary" holes and "dilution" holes are formed through these walls to bring air into the inside of the combustion chamber. The air passing through the primary holes contributes to creating an air/fuel mixture which is burnt in the chamber, while the air passing through the dilution holes serves to encourage dilution of the same air/fuel mixture.

The inner and outer walls, which are generally made of metal, are subjected to the high temperatures of the gases that result from burning the air/fuel mixture. In order to cool them, additional "multiple perforation" orifices are also pierced through the walls over their entire area. These multiple perforation orifices allow the air flowing outside the chamber to penetrate into the inside of the chamber so as to form films of cooling air flowing along the walls.

In practice, it has been found that those zones of the inner and outer walls that are situated directly downstream from a primary hole or a dilution hole suffer from a level of cooling that is small, with the attendant risk of cracks forming.

In order to solve this problem, U.S. Pat. No. 6,145,319 proposes making transition holes through the zones of the walls that are situated directly downstream from each of the primary and dilution holes, these transition holes being inclined to a greater extent than the multiple perforation orifices. Given that that constitutes localized treatment, such a proposal is particularly expensive to implement and increases manufacturing time.

OBJECT AND SUMMARY OF THE INVENTION

A main aim of the present invention is thus to mitigate such drawbacks by proposing an annular wall for a combustion chamber, the wall having additional bores for cooling the zones that are situated directly downstream from a primary hole or a and dilution hole.

To this end, the invention provides an annular wall for a combustion chamber of a turbomachine, the wall having a cold side and a hot side, said wall being provided with a plurality of primary holes and of dilution holes for allowing the air flowing over the cold side of the wall to penetrate to the hot side in order respectively to enable combustion and to provide dilution of an air/fuel mixture, the primary holes and the dilution holes being distributed in circumferential rows; and a plurality of cooling orifices for enabling the air flowing over the cold side of the wall to penetrate to the hot side in order to form a film of cooling air along said wall, said cooling orifices being distributed in a plurality of circumferential rows that are spaced apart axially from one another, the number of cooling orifices being identical in each of the rows; the wall further including a plurality of bores disposed immediately downstream from the primary holes and from the dilution holes an distributed in circumferential rows, the bores in any one row presenting a substantially identical diameter, being spaced apart at a constant pitch, and presenting intrinsic characteristics that are different from the intrinsic characteristics of the cooling orifices of the adjacent rows.

With respect to the bores, the term "intrinsic characteristics" is used to cover the number, the angle of inclination, and the diameter of said bores. The presence of bores having intrinsic characteristics that are different from those of the cooling orifices and that are disposed directly downstream from the primary and dilution holes enables said zones to be cooled effectively. Any risk of crack formation is thus avoided. In addition, the specific bores are distributed in circumferential rows, presenting a common diameter and spaced apart at a constant pitch, thus greatly facilitating boring operations, and thus reducing the cost and the time required for fabricating the wall.

In an embodiment of the invention, the number of bores in a given row may be different from the number of cooling orifices in the adjacent rows.

In another embodiment of the invention, the inclination of the bores in a given row relative to the normal to the wall may be different from the inclination of the cooling orifices of the adjacent rows.

In yet another embodiment of the invention, the diameter of the bores in a given row may be different from that of the cooling orifices in the adjacent rows.

The present invention also provides a combustion chamber and a turbomachine (having a combustion chamber) including an annular wall as defined above.

BRIEF DESCRIPTION OF THE DRAWINGS

Other characteristics and advantages of the present invention appear from the following description given with reference to the accompanying drawings that show an embodiment having no limiting character. In the figures:

FIG. 2 is a fragmentary and developed view of one of the annular walls of the FIG. 1 combustion chamber in an embodiment of the invention; and FIG. 3 is a section view on III-III of FIG. 2.

DETAILED DESCRIPTION OF AN EMBODIMENT

Figure 1:
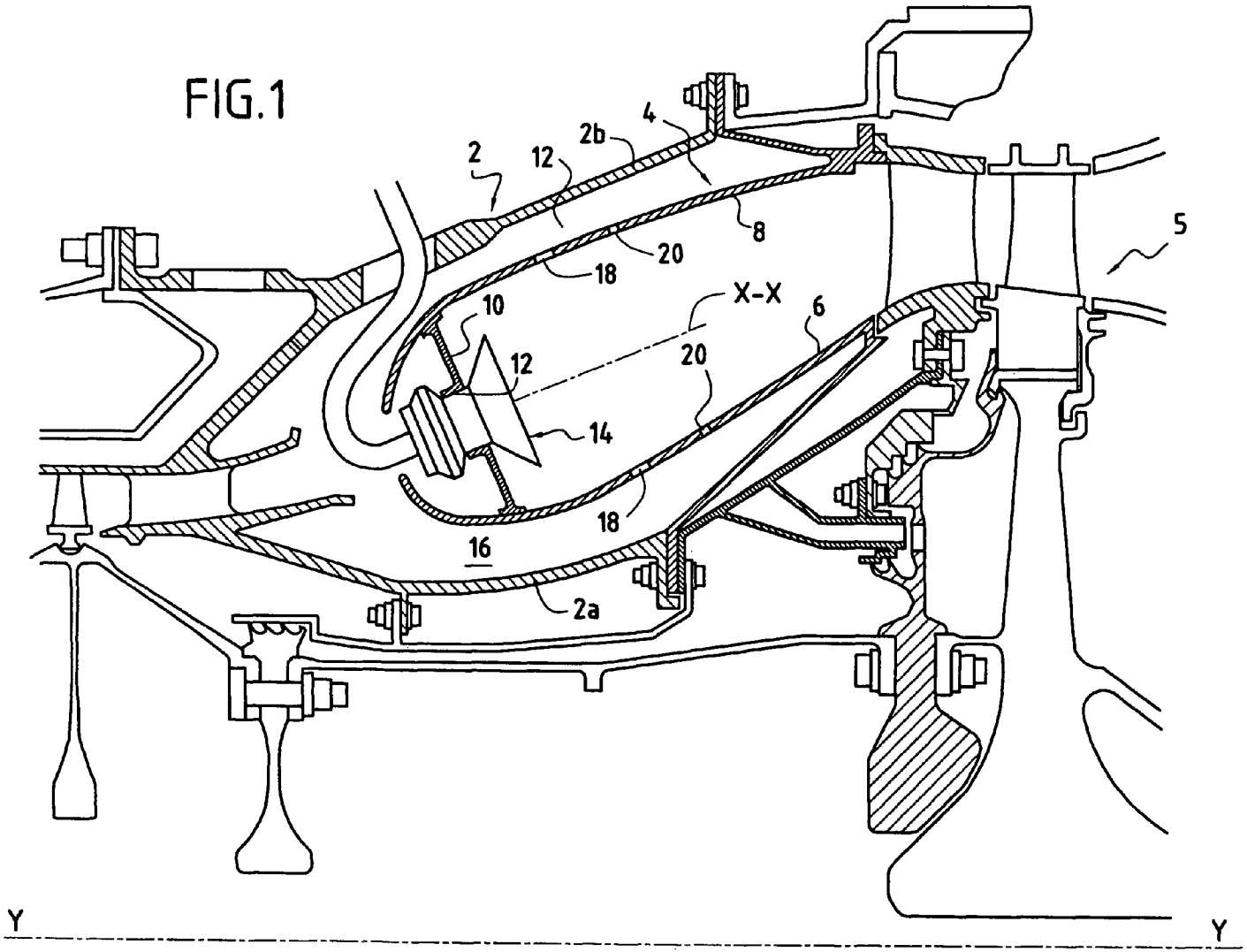
FIG. 1 is a longitudinal section view of a turbomachine combustion chamber in its environment.

FIG. 1 shows a combustion chamber for a turbomachine. Such a turbomachine comprises in particular: a compression section (not shown) in which air is compressed prior to being injected into a chamber casing 2, and then into a combustion chamber 4 mounted inside the casing.

The compressed air is introduced into the combustion chamber and is mixed with fuel prior to being burnt therein. The gas that results from this combustion is then directed towards a high pressure turbine 5 disposed at the outlet from the combustion chamber 4.

The combustion chamber 4 is of the annular type. It is formed by an inner annular wall 6 and by an outer annular wall 8 that are united at their upstream ends by a transverse wall 10 forming an end wall of the chamber.

The inner and outer walls 6 and 8 extend along a longitudinal axis X-X that slopes slightly relative to the longitudinal axis Y-Y of the turbomachine. The chamber end 10 is provided with a plurality of openings 12 having fuel injectors 14 mounted therein.

The chamber casing 2 is formed by an inner shell 2*a* and an outer shell 2*b* and it co-operates with the combustion chamber 4 to define an annular space 16 into which the compressed air is admitted for the purposes of combustion, dilution, and chamber cooling.

Each of the inner and outer walls 6 and 8 presents a cold side 6*a*, 8*a* disposed beside the annular space 16 in which compressed air flows, and a hot side 6*b*, 6*b* facing towards the inside of the combustion chamber 4 (FIG. 3).

The combustion chamber 4 is subdivided into a so-called "primary" zone (or combustion zone) and a so-called "secondary" zone (or dilution zone) situated downstream from the primary zone (downstream being relative to the general flow direction of gas coming from combustion of the air/fuel mixture inside the combustion chamber).

The air feeding the primary zone of the combustion chamber 4 is introduced via one or more circumferential rows of primary holes 18 formed through the inner and outer walls 6 and 8 of the chamber. The air feeding the secondary zone of the chamber passes through a plurality of dilution holes 20 likewise formed in the inner and outer walls 6 and 8. These dilution holes 20 are in alignment on one or more circumferential rows that are offset axially downstream relative to the rows of primary holes 18.

The primary holes 18 and the dilution holes 20 are distributed over the inner and outer walls 6 and 8 in rows that extend over the entire circumference of the walls.

In order to cool the inner and outer walls 6 and 8 of the combustion chamber, which walls are subjected to the high temperatures of the combustion gas, a plurality of cooling orifices 22 are provided (FIGS. 2 and 3).

These orifices 22, that serve to cool the walls 6 and 8 by multiple perforations, are distributed in a plurality of circumferential rows that are axially spaced apart from one another. These rows of multiple perforation orifices cover almost the entire surface of the walls 6, 8 of the chamber.

The number and the diameter d1 of cooling orifices 22 are identical in each of the rows. The pitch p1 between two orifices 22 in a given row is likewise identical over the entire row. Furthermore, the adjacent rows of cooling orifices are arranged in such a manner that the orifices 22 are disposed in a staggered configuration, as can be seen in FIG. 2.

As shown in FIG. 3, the cooling orifices 22 generally present an angle of inclination $\alpha$ relative to a normal N to the annular wall 6, 8 through which they are bored. This angle of inclination $\alpha$ allows the air traveling through these orifices to form a film of air along the hot side 6*b*, 8*b* of the annular wall 6, 8. Compared with orifices that are inclined, it also makes it possible to increase the area of the annular wall that is cooled.

In addition, the angle of inclination $\alpha$ of the cooling orifices 22 is directed in such a manner that the film of air formed in this way flows in the flow direction of the combustion gas inside the chamber (represented by the arrow in FIG. 3).

By way of example, for an annular wall 6, 8 made of a metal or a ceramic material having a wall thickness lying in the range 0.8 millimeters (mm) to 3.5 mm, the diameter d1 of the cooling orifices 22 may lie in the range 0.3 mm to 1 mm, the pitch p1 may lie in the range 1 mm to 10 mm, and the angle of inclination $\alpha$ may lie in the range −80° to +80°. By way of comparison, for an annular wall having the same characteristics, the primary holes 18 and the dilution holes 20 present diameters lying in the range 5 mm to 20 mm.

According to the invention, each annular wall 6, 8 of the combustion chamber further includes a plurality of bores 24 that are disposed immediately downstream from the primary holes 18 and the dilution holes 20 and that are distributed in two circumferential rows.

The bores 24 in any one row present a substantially identical diameter d2, they are spaced apart at a constant pitch p2, and they present intrinsic characteristics that are different from the intrinsic characteristics of the cooling orifices 22 of the adjacent rows.

For each primary hole 18 and dilution hole 20, these bores 24 are thus distributed in one or more rows (e.g. one to three rows) that are disposed immediately downstream from said holes 18, 20.

The intrinsic characteristics of these bores 24 differ from those of the cooling orifices 22, i.e. the number of bores in a given row is different from the number of orifices in a row of cooling orifices, and/or the angle of inclination of the bores in that row relative to the normal N to the wall 6, 8 is different from the angle of inclination of the cooling orifices, and/or the diameter d2 of the bores in a given row is different from the diameter d1 of the cooling orifices 22. It should be observed that differences in two or more of these intrinsic characteristics of the bores 24 may be combined.

Thus, in an embodiment, the number of bores 24 in a given row around the entire circumference of the wall may be about 860 whereas the number of cooling orifices 22 is about 576.

In another embodiment, shown in FIG. 3, the angle of inclination of the bores 24 relative to the normal to the walls 6, 8 is zero (i.e. the bores are substantially perpendicular to the walls), whereas the angle of inclination $\alpha$ of the cooling orifices 22 relative to the same normal lies in the range 30° to 70°.

As mentioned above, the bores 24 in a given row present a diameter d2 that is identical and they are spaced apart at a pitch p2 that is constant. Such bores are typically made using a laser in a machine that is programmed as a function of the position of each of the bores to be made. Thus, the characteristics of the bores of the invention, compared with localized treatment (in which the bores are formed solely in the immediate vicinity of each of the primary holes and each of the dilution holes) makes it possible considerably to simplify the programming of the machine, and thus to reduce manufacturing costs and time.

What is claimed is:

1. An annular wall for a combustion chamber of a turbomachine, the wall having a cold side and a hot side, said wall comprising:

a plurality of primary holes which allows air flowing over the cold side of the wall to penetrate to the hot side in order to enable combustion, the primary holes being distributed in circumferential rows;

a plurality of dilution holes which allows the air flowing over the cold side of the wall to penetrate to the hot side in order to provide dilution of an air/fuel mixture, the dilution holes being distributed in circumferential rows;

a plurality of cooling orifices which enables the air flowing over the cold side of the wall to penetrate to the hot side in order to form a film of cooling air along said wall, said cooling orifices being distributed in a plurality of circumferential rows that are spaced apart axially from one another, the number of cooling orifices being identical in each of the rows; and a plurality of bores disposed immediately downstream from the primary holes and from the dilution holes and distributed in circumferential rows, wherein the bores in any one row include a substantially identical diameter, are spaced apart at a constant pitch, and include intrinsic characteristics that are different from intrinsic characteristics of the cooling orifices of the adjacent rows, and wherein the angle of inclination of the bores in a given row relative to a normal to the wall is different from the angle of inclination of the cooling orifices of the adjacent rows.

2. The wall according to claim 1, wherein the number of bores in a given row is different from the number of cooling orifices in the adjacent rows.

3. The wall according to claim 2, wherein the number of bores in the given row is greater than the number of cooling orifices in the adjacent rows.

4. The wall according to claim 1, wherein the diameter of the bores in a given row is different from the diameter of the cooling orifices of the adjacent rows.

5. The wall according to claim 4, wherein the diameter of the bores in the given row is greater than the diameter of the cooling orifices of the adjacent row.

6. A turbomachine combustion chamber including at least one annular wall according to claim 1.

7. A turbomachine including a combustion chamber having at least one annular wall according to claim 1.

8. The wall according to claim 1, wherein the angle of inclination of the bores relative to the normal to the wall is zero and the angle of inclination of the cooling orifices of the adjacent rows is between 30° and 70°.

9. The wall according to claim 1, wherein the pitch between the bores in any one row is measured as a distance in a circumferential direction between a center of a bore and a center of an adjacent bore.

* * * * *